US010166661B2

(12) United States Patent
Huang et al.

(10) Patent No.: US 10,166,661 B2
(45) Date of Patent: Jan. 1, 2019

(54) ELECTRONIC DEVICE FOR CHECKING FASTENING STATE OF SCREWS

(71) Applicants: HONGFUJIN PRECISION ELECTRONICS (ZHENGZHOU) CO., LTD., Zhengzhou (CN); HON HAI PRECISION INDUSTRY CO., LTD., New Taipei (TW)

(72) Inventors: Guo-Liang Huang, Shenzhen (CN); Rong-Yun Sun, Shenzhen (CN); Bao-Rui Han, Shenzhen (CN); Yan-Mei Zhang, Shenzhen (CN); Xiao-Kui Xu, Shenzhen (CN)

(73) Assignees: HONGFUJIN PRECISION ELECTRONICS (ZHENGZHOU) CO., LTD., Zhengzhou (CN); HON HAI PRECISION INDUSTRY CO., LTD., New Taipei (TW)

( * ) Notice: Subject to any disclaimer, the term of this patent is extended or adjusted under 35 U.S.C. 154(b) by 264 days.

(21) Appl. No.: 15/088,632

(22) Filed: Apr. 1, 2016

(65) Prior Publication Data

US 2017/0106509 A1 Apr. 20, 2017

(30) Foreign Application Priority Data

Oct. 20, 2015 (CN) ..... 2015 1 0678693

(51) Int. Cl.

| | |
|---|---|
| ***B25B 23/147*** | (2006.01) |
| ***B25B 21/00*** | (2006.01) |
| ***B25B 11/02*** | (2006.01) |

(52) U.S. Cl.

CPC ..... *B25B 23/147* (2013.01); *B25B 11/02* (2013.01); *B25B 21/00* (2013.01)

(58) Field of Classification Search

CPC ..... B25B 23/147; B25B 11/02; B25B 21/00; B25B 23/14; B25B 23/141; B25B 21/008

See application file for complete search history.

(56) References Cited

U.S. PATENT DOCUMENTS 5,404,643 A * 4/1995 Rice ..... B23P 19/066 29/407.02

2014/0262405 A1* 9/2014 Jones ..... B23P 19/06 173/198

* cited by examiner

*Primary Examiner* — Robert Scruggs

(74) *Attorney, Agent, or Firm* — ScienBiziP, P.C.

(57) ABSTRACT

An electronic device for checking a fastening state of screws includes a receiving member, a cover, an electric screwdriver, a processor, and a warning unit. The receiving member receives a mountable device. The cover includes a number of screw guiding members, the screw guiding members guides the screws into screw holes on the mountable device. The electric screwdriver fastens the screws into the screw holes on the mountable device. The processor predefines an order of the electric screwdriver fastening the screws in response to operations of an operator; in a process of the electric screwdriver fastening the screws into the screw holes on the mountable device received in the receiving member, checks whether the fastening order is the same as the predefined order; and when the fastening order is not the same as the predefined order, controls the warning unit to output a warning message.

12 Claims, 5 Drawing Sheets

ELECTRONIC DEVICE FOR CHECKING FASTENING STATE OF SCREWS

CROSS-REFERENCE TO RELATED APPLICATIONS

This application claims priority to Chinese Patent Application No. 201510678693.4 filed on Oct. 20, 2015, the contents of which are incorporated by reference herein.

FIELD

The subject matter herein generally relates to screw mechanisms, and particularly to an electronic device for checking a fastening state of screws.

BACKGROUND

In assembly processes of many electronic devices, such as smart phones, tablet computers etc., components or mechanisms of such electronic devices usually are fastened via screws.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
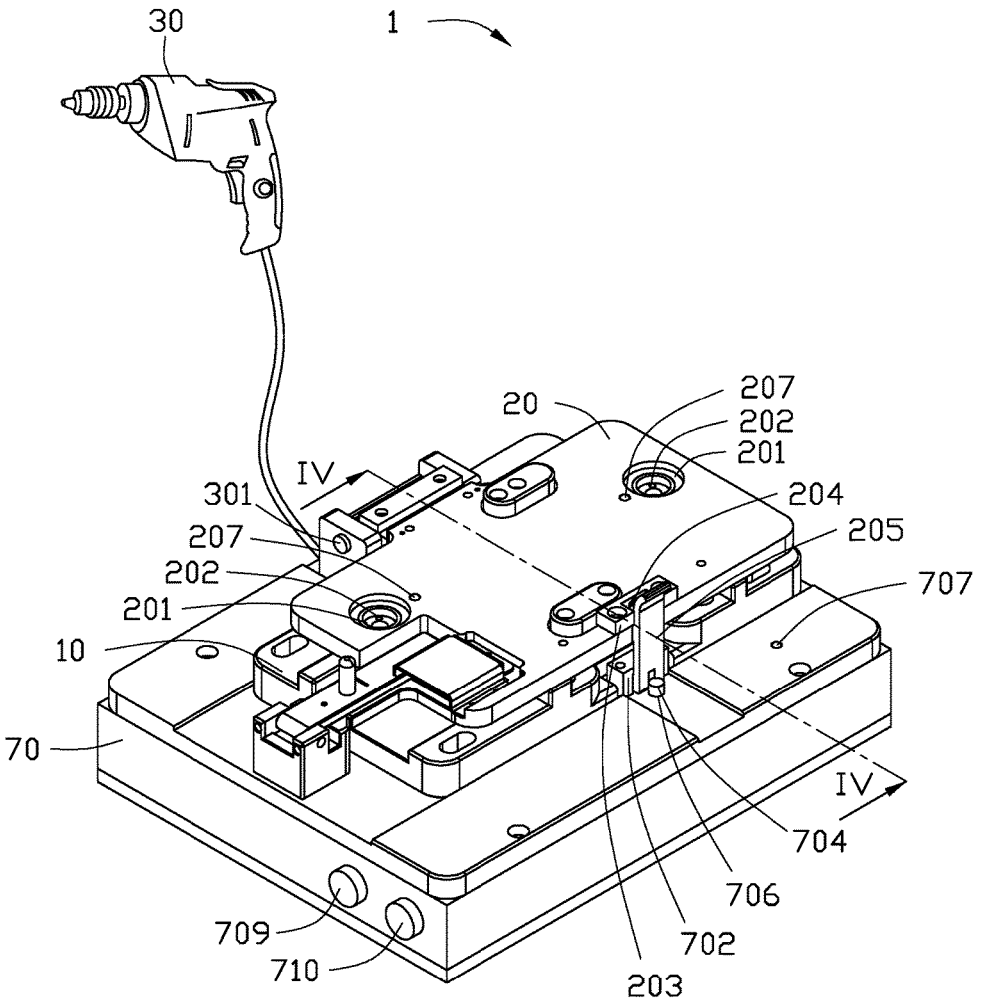
FIG. 1 is an isometric view showing an embodiment of an electronic device for checking a fastening state of screws.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts can be exaggerated to better illustrate details and features. The description is not to be considered as limiting the scope of the embodiments described herein.

The term "comprising" means "including, but not necessarily limited to"; it specifically indicates open-ended inclusion or membership in a so-described combination, group, series and the like.

Embodiments of the present disclosure will be described with reference to the accompanying drawings.

FIG. 1 illustrates an electronic device 1 for checking a fastening state of screws. The electronic device 1 includes a receiving member 10, a cover 20, and an electric screwdriver 30. The receiving member 10 defines a receiving space 101 (shown in FIG. 3) for receiving a mountable device (not shown) to be mounted via screws. In the illustrated embodiment, the mountable device can be a printed circuit board. The cover 20 covers the receiving member 10 and includes a number of screw guiding members 201. When the cover 20 covers the receiving member 10, the mountable device is received in the receiving member 10.

Each of the screw guiding members 201 is a through hole, and is defined on the cover 20. Each of the screw guiding members 201 corresponds to a screw hole on the mountable device, the screw guiding members 201 guide the screws into the screw holes on the mountable device. In the illustrated embodiment, a quantity of the screw guiding members 201 is the same as a quantity of the screw holes on the mountable device, for example, when the mountable device has two screw holes, two screw guiding members 201 are accordingly defined on the cover 20. The electric screwdriver 30 fastens the screws into the screw holes on the mountable device.

Figure 2:
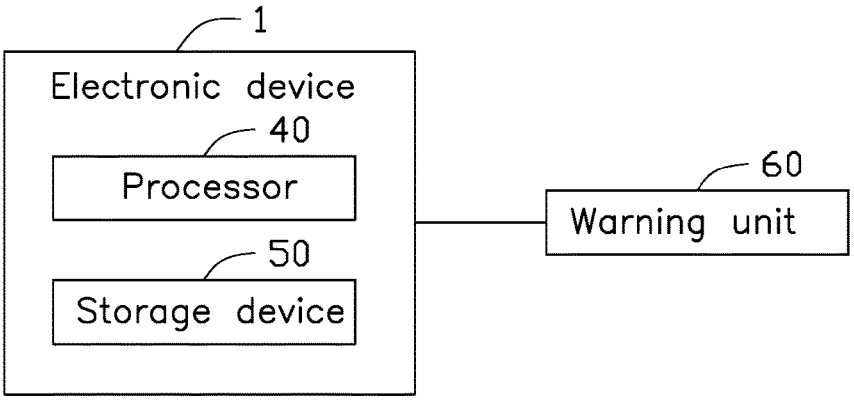
FIG. 2 is a block diagram of the electronic device of FIG. 1.

As illustrated in FIGS. 1-2, the electronic device 1 further includes a processor 40, a storage device 50, and a warning unit 60. When the electric screwdriver 30 does not fasten the screws in correct order, the warning unit 60 outputs a warning message. In the illustrated embodiment, the processor 40, the storage device 50, and the warning unit 60 are integrated in a circuit board of the electronic device 1. In the illustrated embodiment, the circuit board is arranged in the cover 20. The warning unit 60 can be a buzzer and make a sound as the warning message. In other embodiments, the warning unit 60 can be a warning light which outputs light, or a display screen which shows words as the warning message.

In at least one embodiment, the storage device 50 can include various types of non-transitory computer-readable storage mediums. For example, the storage device 50 can be an internal storage system, such as a flash memory, a random access memory (RAM) for temporary storage of information, and/or a read-only memory (ROM) for permanent storage of information. The storage device 50 can also be an external storage system, such as a hard disk, a storage card, or a data storage medium. The at least one processor 40 can be a central processing unit (CPU), a microprocessor, or other data processor chip that performs functions of the electronic device 1.

In the illustrated embodiment, the storage device 50 stores a number of instructions, and when the instructions are executed by the processor 40, the instructions cause the processor 50 to implement functions as follows.

The processor 40 predefines an order of the electric screwdriver 30 fastening the screws, in response to operations of an operator. In the illustrated embodiment, if the mountable device has an inherent order of mounting the screws, the processor 40 can further predefine the fastening order based on the inherent order. In other embodiments, the fastening order corresponds to positions of the screw guiding members 201 of the cover 20, for example, it maybe in order from left to right or in order from top to bottom.

In a process of the electric screwdriver 30 fastening the screws on the mountable device received in the receiving member 10, the processor 40 further checks whether the fastening order is the same as the predefined order. In the illustrated embodiment, the cover 20 includes a number of first sensors 202. Each of the first sensors 202 is arranged to be associated with the position of each of the screw guiding members 201. When one first sensor 202 senses the presence of the electric screwdriver 30, that means that the electric screwdriver 30 is fastening the screw at the position of the screw guiding member 201 corresponding to the first sensor 202.

If the first sensors 202 sense an order of the electric screwdriver 30 fastening the screws on the mountable device, the processor 40 compares the sensed order of the electric screwdriver 30 fastening the screws to the predefined order. If the sensed order is the same as the predefined order, that means that the electric screwdriver 30 is fastening the screws on the mountable device in the predefined order. If the sensed order is not the same as the predefined order, that means that the electric screwdriver 30 is not fastening the screws on the mountable device in the predefined order.

When the processor 40 determines that the fastening order is not the same as the predefined order, the processor 40 controls the warning unit 60 to output the warning message. In the illustrated embodiment, the warning unit 60 outputs the warning message to remind the operator that the electric screwdriver 30 is not fastening the screws in the predefined order, thus urging the operator to correct an error.

In the process of fastening the screws, if a torsional resistance experienced by the electric screwdriver 30 reaches a preset level, the processor 40 controls the electric screwdriver 30 to stop working. A slight torsional resistance may lead to the screws not being fastened tightly and a great torsional resistance may lead to the screws being damaged. In the illustrated embodiment, the storage device 50 stores a number of preset torsional resistance level corresponding to different kinds of screws with different specifications. When the operator selects one of the specifications of the screws to be mounted, the processor 40 presets a torsional resistance level corresponding to the selected specification. When the torsional resistance of the electric screwdriver 30 reaches the preset level, that means that the corresponding screw is fastened suitably, the processor 40 controls the electric screwdriver 30 to stop working.

Figure 3:
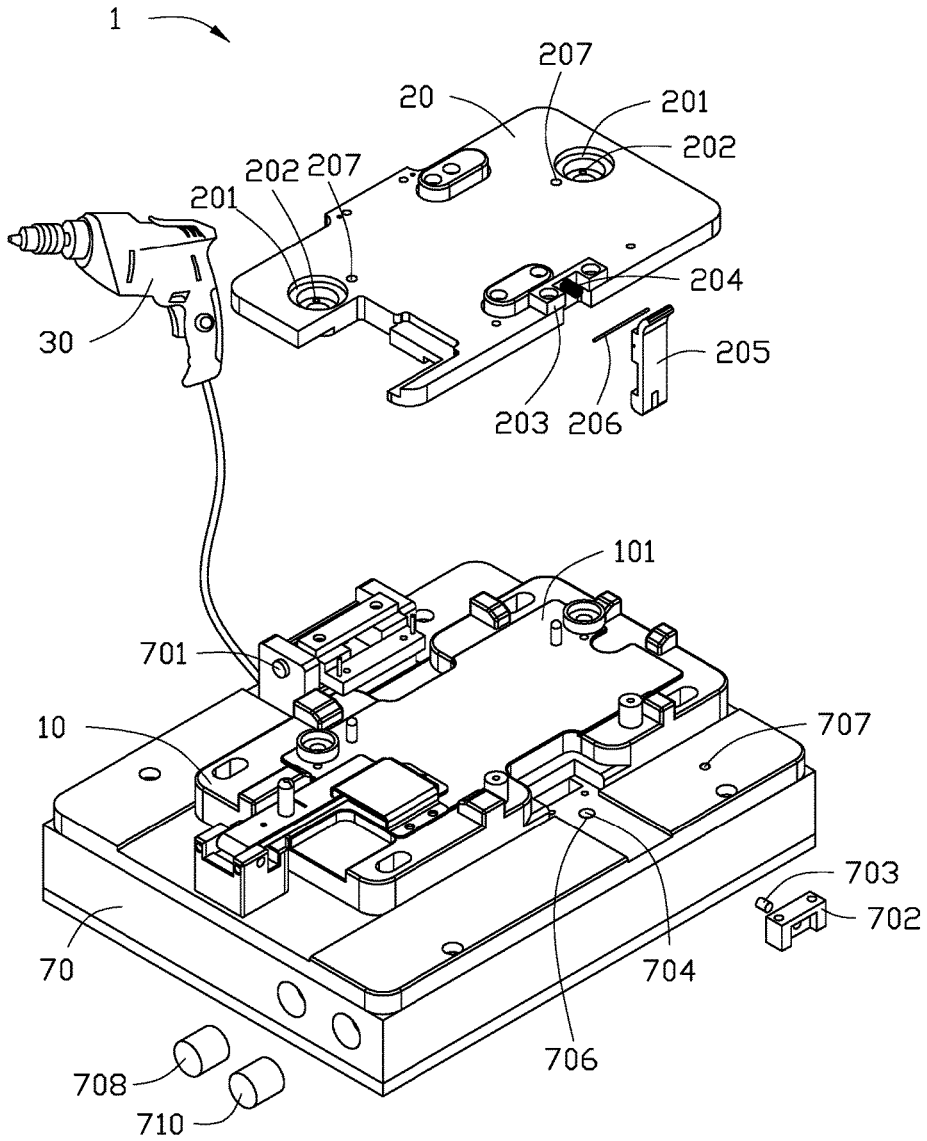
FIG. 3 is an exploded, isometric view of the electronic device of FIG. 1.

As illustrated in FIG. 3, the cover 20 includes a fixing member 203, a spring 204, a fastening member 205, and a first shaft 206. The fixing member 203 is fixed on an edge of the cover 20. One end of the spring 204 is fixed on the fixing member 203, and another end of the spring 204 is fixed on the fastening member 205. The first shaft 206 passes through the fastening member 205. Two ends of the first shaft 206 are fixed on the fixing member 203. The fastening member 205 is rotatably connected to the fixing member 203 via the first shaft 206.

Figure 4:
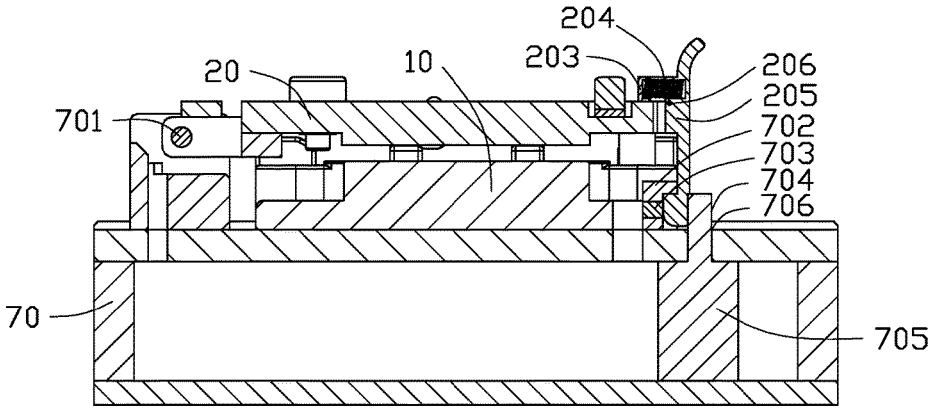
FIG. 4 is a cross-sectional view of the electronic device of FIG. 1 along a line IV-IV.

As illustrated in FIG. 4, the electronic device 1 further includes an electric cabinet 70. The electric cabinet 70 provides power to the electronic device 1. The receiving member 10 is arranged on an upper surface of the electric cabinet 70. The electric cabinet 70 includes a second shaft 701, a latching member 702, a second sensor 703, a dowel pin 704, and an air cylinder 705. The second shaft 701 and the latching member 702 are fixed on the upper surface of the electric cabinet 70. The second sensor 703 is fixed on the latching member 702, the second sensor 703 is used for sensing the fastening member 205 of the cover 20. The upper surface of the electric cabinet 70 defines a through hole 706 in a position corresponding to the dowel pin 704. The air cylinder 705 is arranged in the electric cabinet 70. The dowel pin 704 is connected to the air cylinder 705, and passes through the through hole 706 and is movably fixed to be close to the latching member 702.

The cover 20 is rotatably connected to the electric cabinet 70 via the second shaft 701. The operator can rotate the cover 20 to cover the upper surface of the electric cabinet 70, then the operator can fasten the fastening member 205 on the latching member 702.

Figure 5:
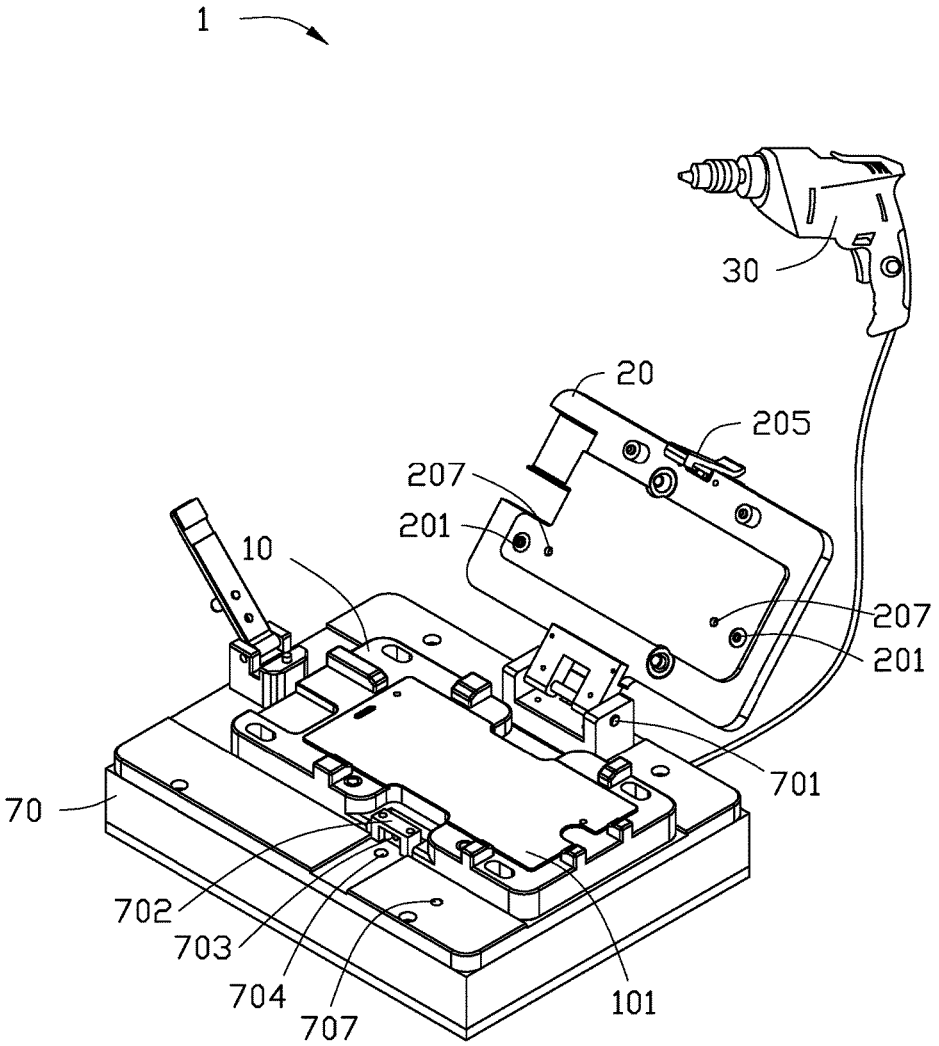
FIG. 5 is an exploded, isometric view of the electronic device of FIG. 1 with cover opened.

As illustrated in FIGS. 1-2 and FIG. 5, when the second sensor 603 senses the presence of the fastening member 205, the processor 40 further controls the air cylinder 705 to drive the dowel pin 704 to rise until the dowel pin 704 extends out from the upper surface of the electric cabinet 70 and latches the fastening member 205. When the electric screwdriver 30 finishes fastening the screws, the processor 40 controls the air cylinder 705 to drive the dowel pin 704 to go down until the dowel pin 704 aligns with the upper surface of the electric cabinet 70, and depart from the fastening member 205.

When the second sensor 703 senses that the fastening member 205 is latched on the latching member 702, that means that the electric screwdriver 30 is fastening the screws, the dowel pin 704 is extended out from the upper surface of the electric cabinet 70 and is latched with the fastening member 205, thus avoiding having to open the cover 20 because of error during the process of fastening the screws. When the electric screwdriver 30 finishes fastening the screws, the dowel pin 704 goes down and aligns with the upper surface of the electric cabinet 70. The operator can thus move the fastening member 205 away from the latching member 702, then open the cover 20, and further take the mountable device out of the receiving space 101.

As illustrated in FIGS. 1-2, the upper surface of the electric cabinet 70 defines a first light 707. The cover 20 defines a second light 207 at the position corresponding to one of the screw guiding members 201. In the illustrated embodiment, the first light 707 and the second light 207 both are LED lights.

When the electric cabinet 70 connects to a power supply, the processor 40 controls the first light 707 and the second light 207 to shine red. When the second sensor 703 senses the presence of the fastening member 205 of the cover 20, the processor 40 controls the first light 707 to shine green, thus indicating to the operator that the electric screwdriver 30 can start fastening the screws. When the fastening process of the screw at the position of one screw guiding member 201 is finished, the processor 40 controls the corresponding second light 207 to shine green, thus indicating that the electric screwdriver 30 can fasten the next screw in the predefined order. Until the second sensor 703 senses the presence of the fastening member 205 of the cover 20, the processor 40 controls the first light 707 and the second light 207 to shine red, thus warning that the cover 20 is open.

As illustrated in FIG. 1 and FIGS. 3-4, the electric cabinet 70 defines a first button 708 and a second button 709 on a side of the electric cabinet 70. The processor 40 further controls the dowel pin 704 which extends out from the upper surface of the electric cabinet 70 to go down until the dowel pin 704 aligns with the upper surface of the electric cabinet 70, in response to the operator pressing the first button 708. When a halt is necessary during the process of fastening the screws, for example, the screw guiding member 201 does not align with the screw hole of the mountable device, the operator can press the first button 708, the dowel pin 704 goes down until alignment with the upper surface of the electric cabinet 70 is reached. Then the cover 20 can be opened.

The processor 40 further controls the second light 207 at the position of the screw guiding member 201 corresponding to one fastened screw to shine red, in response to the operator pressing the second button 709. When one screw is fastened, but a halt is required, for example, a fastening position of the screw is incorrect, the operator can press the second button 709. Upon pressing, the second light 207 at the position of the screw guiding member 201 corresponding to the fastened screw shines red, thus the electric screwdriver 30 can resume fastening the screw.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being exemplary embodiments of the present disclosure.

What is claimed is:

1. An electronic device for checking a fastening state of screws comprising:

a receiving member configured to receive a mountable device to be mounted via screws;

a cover covering the receiving member and comprising a plurality of screw guiding members, wherein the screw guiding members are used for guiding the screws into screw holes on the mountable device;

an electric screwdriver configured to fasten the screws into the screw holes on the mountable device;

a processor coupled to the electric screwdriver;

a plurality of first sensors arranged on the cover and coupled to the processor, wherein each of the first sensors is arranged to be associated with the position of each of the screw guiding members, the first sensor senses presence of the electric screwdriver on the corresponding position, and transmit a sensed signal to the processor;

a warning unit coupled to the processor;

a storage device coupled to the processor and storing a plurality of instructions for execution by the processor to cause the processor to:

predefine an order of the electric screwdriver fastening the screws in response to operations of an operator;

check, in a process of the electric screwdriver fastening the screws into the screw holes on the mountable device received in the receiving member, whether the fastening order is the same as the predefined order according to the sensed signals from the plurality of first sensors; and control, when the fastening order is not the same as the predefined order, the warning unit to output a warning message.

2. The electronic device according to claim 1, wherein the processor is further caused to:

compare, if the first sensors sense the order of the electric screwdriver fastening the screws on the mountable device, the sensed order to the predefined order according to the sensed signals from the first sensors.

3. The electronic device according to claim 1, wherein the processor is further caused to:

control, if a torsional resistance experienced by the electric screwdriver reaches a preset level, the electric screwdriver to stop working.

4. The electronic device according to claim 1, wherein the cover further comprises a fixing member, a spring, a fastening member, and a first shaft, the fixing member is fixed on an edge of the cover, one end of the spring is fixed on the fixing member, and another end of the spring is fixed on the fastening member, the first shaft passes through the fastening member, and two ends of the first shaft are fixed on the fixing member, the fastening member is rotatably connected to the fixing member via the first shaft.

5. The electronic device according to claim 4, further comprising:

an electric cabinet, wherein the receiving member is arranged on an upper surface of the electric cabinet, the electric cabinet comprises a second shaft, a latching member, a second sensor, and a dowel pin, the second shaft and the latching member are fixed on the upper surface of the electric cabinet, the second sensor is fixed on the latching member, the second sensor is used for sensing the fastening member of the cover, the dowel pin is movably fixed to be close to the latching member, the cover is rotatably connected to the electric cabinet via the second shaft.

6. The electronic device according to claim 5, wherein the processor is further caused to:

control, when the second sensor senses the presence of the fastening member, the dowel pin to rise until the dowel pin extends out from the upper surface of the electric cabinet and latches the fastening member; and control, when the electric screwdriver finishes fastening the screws, the dowel pin to go down until the dowel pin aligns with the upper surface of the electric cabinet, and depart from the fastening member.

7. The electronic device according to claim 6, wherein the electric cabinet further comprises an air cylinder, the dowel pin is driven by the air cylinder, the processor is further caused to:

control the air cylinder to drive the dowel pin to rise or go down.

8. The electronic device according to claim 6, wherein the upper surface of the electric cabinet defines a first light, the cover defines a second light at the position corresponding to one of the screw guiding members.

9. The electronic device according to claim 8, wherein the processor is further caused to:

control, when the electric cabinet connects to a power supply, the first light and the second light to shine red;

control, when the second sensor senses the presence of the fastening member of the cover, the first light to shine green;

control, when the fastening process of the screw at the position of one screw guiding member is finished, the corresponding second light to shine green; and control, until the second sensor senses the presence of the fastening member of the cover, the first light and the second light to shine red.

10. The electronic device according to claim 8, wherein the first light and the second light both are LED lights.

11. The electronic device according to claim 8, wherein the electric cabinet defines a first button and a second button on a side of the electric cabinet.

12. The electronic device according to claim 11, wherein the processor is further caused to:

control the dowel pin which extends out from the upper surface of the electric cabinet to go down until the dowel pin aligns with the upper surface of the electric cabinet, in response to the operator pressing the first button; and control the second light at the position of the screw guiding member corresponding to one fastened screw to shine red, in response to the operator pressing the second button.

* * * * *